US006652194B2

(12) United States Patent
Ingle

(10) Patent No.: US 6,652,194 B2
(45) Date of Patent: Nov. 25, 2003

(54) JACK-UP MOBILE OFFSHORE DRILLING UNITS (MODUS) AND JACKING METHOD AND APPARATUS

(75) Inventor: James E. Ingle, Ellettsville, IN (US)

(73) Assignee: OSL Offshore Systems & Deck Machinery, LLC, Dallas, TX (US)

( * ) Notice: Subject to any disclaimer, the term of this patent is extended or adjusted under 35 U.S.C. 154(b) by 0 days.

(21) Appl. No.: 09/835,794

(22) Filed: Apr. 16, 2001

(65) Prior Publication Data

US 2003/0007838 A1 Jan. 9, 2003

(51) Int. Cl.[7] ..... E02B 17/08; B66F 1/00

(52) U.S. Cl. ..... 405/198; 405/195.1; 405/196; 254/95; 254/105

(58) Field of Search ..... 405/195.1, 196, 405/198, 199; 254/89, 94, 95, 97, 105–112

(56) References Cited

U.S. PATENT DOCUMENTS

| | | | | | |
|---|---|---|---|---|---|
| 3,876,181 | A | * | 4/1975 | Lucas | 254/107 |
| 4,270,877 | A | * | 6/1981 | Post | 405/198 |
| 4,387,881 | A | * | 6/1983 | McDuffie | 254/95 X |
| 4,411,408 | A | * | 10/1983 | Radovan et al. | 254/108 |
| 4,479,401 | A | * | 10/1984 | Korkut | 254/108 X |
| 4,589,799 | A | * | 5/1986 | Hotta et al. | 405/196 |
| 4,655,640 | A | | 4/1987 | Gillis | |
| 4,813,814 | A | * | 3/1989 | Shibuta et al. | 254/95 X |
| 5,139,366 | A | * | 8/1992 | Choate et al. | 405/198 |
| 5,139,367 | A | | 8/1992 | Ingle | |
| 5,486,069 | A | * | 1/1996 | Breeden | 405/198 |
| 5,906,457 | A | * | 5/1999 | Choate et al. | 254/112 X |
| 5,915,882 | A | * | 6/1999 | Darwiche et al. | 405/198 |
| 6,030,149 | A | * | 2/2000 | Foo et al. | 405/199 |

FOREIGN PATENT DOCUMENTS

| | | | | |
|---|---|---|---|---|
| JP | 60175624 | * | 9/1985 | 405/198 |

* cited by examiner

*Primary Examiner*—Jong-Suk (James) Lee
(74) *Attorney, Agent, or Firm*—Brinks Hofer Gilson & Lione

(57) ABSTRACT

A mobile offshore drilling unit (MODU) jacking system includes a plurality of hydraulic continuous linear motion motors, preferably comprising a plurality of phased hydraulic piston/cylinder units, that are engaged with a plurality of MODU supporting legs to provide continuous relative motion between the MODU platform and its supporting legs, and to also maintain the MODU platform and MODU supporting legs locked in a stationary relationship. In the preferred jack-up system, the number of hydraulic piston/cylinder units and the number and design of the teeth that are engaged in providing relative motion may be combined to substantially reduce material stresses on the system.

35 Claims, 9 Drawing Sheets

END CYL. STROKE

MID CYL. STROKE

BEGINNING STROKE

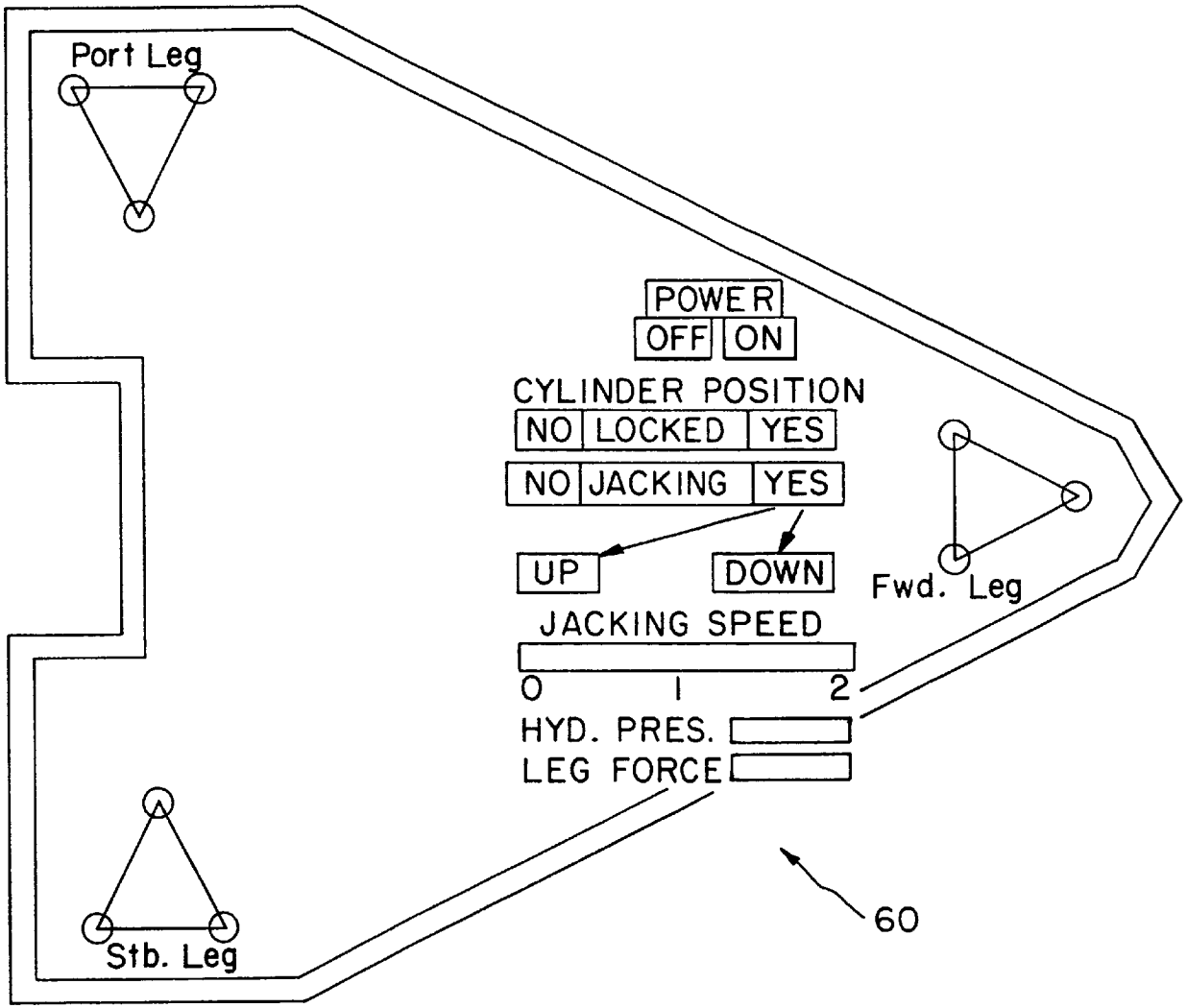
Fig. 16
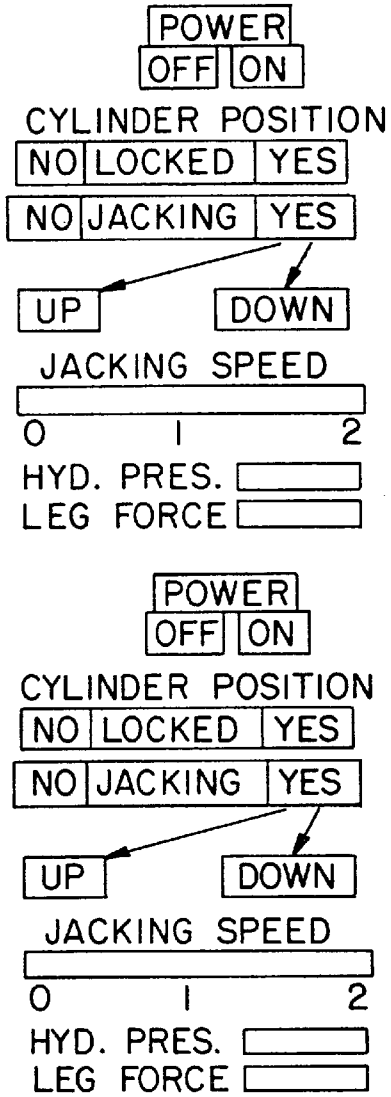

JACK-UP MOBILE OFFSHORE DRILLING UNITS (MODUS) AND JACKING METHOD AND APPARATUS

FIELD OF THE INVENTION

This invention relates to mobile offshore dwelling units (MODUs), and more particularly to MODU jacking systems, apparatus and methods.

BACKGROUND OF THE INVENTION

Offshore structures are not unknown. In 1955 the U.S. Army Corps. of Engineers constructed radar stations along the New England coast, which were commonly referred to as "Texas Towers." In constructing these radar stations, the radar platforms were lifted on supporting legs, using hydraulic cylinders. While the legs and the platform were pinned together, a plurality of hydraulic cylinders were manually attached between the supporting legs and the platform. The pins holding the platform stationary with respect to the legs were removed, and the hydraulic cylinders were then pressurized to extend their pistons and raise the radar platform. At the end of the pistons' strokes, the pins holding the platform in position with respect to the supporting legs were manually replaced to hold the platform in a stationary position with respect to the legs so the plurality of cylinders could be disconnected from the platform and the legs, and their pistons could be retracted without affecting the relative positions of the platform and the legs. The plurality of hydraulic cylinders were then manually reattached between the platform and the legs, and the pins holding the platform stationary with respect to the legs were manually removed, and the hydraulic cylinders were operated again to extend their pistons and raise the platform with respect to the legs. This procedure was repeated again and again until the platform was lifted to its desired position with respect to the plurality of legs. This method of construction was labor-intensive, slow, and expensive.

The increasing need for oil and gas has led to offshore exploration, requiring drilling into the earth's surface far below the water. Such drilling operations are accomplished from mobile offshore drilling units (MODUs). MODUs generally comprise submersible, semi-submersible and jack-up types, with which the invention is concerned. Jack-up MODUs are massive structures which can have platform surface areas as large as two acres to support the drilling equipment, drilling supplies, power sources, living quarters, helicopter landing ports, and the stores and fuel that are necessary to maintain a drilling crew and operate the MODU and its drilling equipment hundreds of feet above the underwater surface. Jack-up MODUs include a plurality of MODU supporting legs, most generally three legs, that are moveably engaged with the MODU platform. Following their construction, such MODUs, with their MODU platforms resting on footings at the base of each supporting leg are towed to an offshore drilling site, like a large vessel with three 700 foot masts. Once the MODU is positioned at a drilling site offshore, the MODU supporting legs are lowered to engage the earth's underwater surface and thereafter lift, or jack-up, the MODU platform sufficiently above the water level to reduce exposure of the MODU platform to wave action during severe storms. It is not uncommon for jack-up MODUs to weigh 30,000 to 40,000 tons, or more, with the MODU platform and its variable loads comprising as much as two-thirds of the weight. In addition, it is not uncommon for the MODU supporting legs to have lengths of 600 to 700 feet, and, to provide stability in their support of the MODU platform, to have cross sections, most commonly triangular, up to 50 feet on a side.

The jack-up MODUs currently in use and being constructed include, as the apparatus to adjust the relative position of the MODU platform and MODU supporting legs, a plurality of motor-driven spur gears which engage toothed racks running the length of each corner leg chord of each MODU supporting leg. The leg chords that comprise the corners of the MODU supporting legs of such currently existing jack-up MODUs are constructed with a central toothed rack, of expensive high strength (e.g., 100 KSI) steel, running the length of the supporting leg, with rigidifying semi-circular, tubular structural members welded along both sides of the toothed rack to increase the strength, section modulus and rigidity of the leg chords. Because the spur gears rotationally engage the toothed racks of the leg chords in raising and lowering the MODU supporting legs with respect to the MODU platform, the spur gear teeth and the teeth of the leg chord racks have cycloidal cross sections, and the spur gear drives are each engaged with the leg chord racks by line contact between a single tooth of the spur gear and a single mating tooth of a toothed rack, exposing the teeth of both the spur gear and the rack to extremely high shear forces and requiring that the spur gears and the toothed rack be made of an expensive high-grade steel, with a modulus of elasticity, for example, of 100,000 pounds per square inch (100 KSI).

Because of the great weights being handled and the high stress engagement between the spur gear teeth and rack teeth, as many as 18 spur gear drive units may be engaged with the six toothed racks on each supporting leg. In such systems, the plural spur gear drives are mounted vertically in sets of three units, one above another, so their pinion gears can engage the toothed racks that comprise the leg chords; however, the load is unequally shared by the plurality of engaged pinion gears, the lowest pinion gear and its engaged rack tooth carrying a significantly disproportionate portion of the load. Because the tooth loading in current spur gear driven jack-up MODUs is approaching the stress and fatigue limits of the available materials, complex controls for the electric motors of the spur gear drives have been developed in an effort to equalize the loads that are borne by the plurality of engaged gears and the associated stresses and fatigue. Such controls control the torques generated by the electric motors to balance the loads on their pinion gears and gradually accelerate and decelerate in an effort to avoid overstressing and fatiguing the engaged teeth. Further, during operation of the spur gear drives, grease must be mopped onto the rack teeth by the MODU crew to reduce the friction between the pinion gears and the leg chord racks, and the grease inevitably falls into the sea.

In addition to requiring expensive controls, materials and manufacturing procedures, spur gear-driven jack-up MODUs also require expensive separate locking apparatus for each supporting leg to maintain the MODU platform in a stationary position with respect to its supporting legs.

The jacking systems of jack-up MODUs are currently expensive to design and manufacture and are not expected to satisfy future requirements. There is an increasing demand for larger jack-up MODUs with dramatically greater topside loads. The ability to meet this demand has, however, approached its practical limit with existing materials and technology, and a new jack-up MODU and MODU jacking system are needed.

BRIEF SUMMARY OF THE INVENTION

The invention provides a new jack-up MODU and MODU jacking system that can reliably handle loads several times greater than can be currently handled, can be readily and inexpensively designed and scaled for different jack-up loads, and can save millions of dollars in the manufacture of a single jack-up MODU.

In one aspect of the invention, a plurality of MODU-carried continuous linear motion motors are engaged with a plurality of MODU supporting legs to provide relative motion between the MODU platform and its supporting legs, and to also maintain the MODU platform and MODU supporting legs locked in a stationary relationship. As used herein, the term "continuous linear motion motor," refers to a plurality of hydraulic piston/cylinder units N whose piston operations are phased so that N−1 of the plurality of piston/cylinder units are engaged with a MODU-supporting leg and providing relative motion while one of the piston/cylinder units is disengaged from the MODU-supporting leg and being repositioned for re-engagement with the supporting leg to continue the relative motion. The invention thus permits a MODU platform to be automatically jacked up hydraulically with continuous motion, avoiding the excess forces needed to overcome static friction and to accelerate the heavy masses of the MODU.

In the invention, a plurality of hydraulic piston/cylinder units are used to provide continuous relative motion of the MODU with respect to a plurality of MODU-supporting legs that carry a plurality of toothed racks, by phased operation of their pistons, that is, by sequentially engaging different groups of the piston/cylinder units with the plurality of toothed racks and driving their pistons with hydraulic pressure, while another group of the piston/cylinder units are disengaged from the toothed racks and are repositioned for reengagement by application of hydraulic pressure to the cylinders of the disengaged pistons. The pluralities of hydraulic piston/cylinders in their phased operations provide a plurality of continuous linear motion motors that can be controlled from the MODU to jack the MODU up or down, or to lock the MODU in any stationary position. Such a plurality of continuous linear motion motors are substantially less expensive than a comparable plurality of spur gear drives.

In the invention, a multiplicity of teeth are engaged in providing relative motion (and in lifting the MODU platform) at any given moment of time, eliminating high tooth stress by spreading the load imposed by the large weight of the MODU over the multiplicity of teeth provided by a plurality of toothed rack engagement members driven by the plurality of pistons. Furthermore, in the invention, the teeth of the rack engagement members being driven by the pistons of the hydraulic cylinders, and the teeth of the plurality of racks being driven thereby are formed with substantially planar engagement surfaces that spread the stresses from the driving forces uniformly over and through the engaged teeth, and the substantially planar engagement surfaces of the engaged teeth are preferably angled to be normal to the central axes of the plurality of pistons within the central portion of the pistons' movements.

In another aspect, the invention eliminates the large forces acting transversely on the toothed racks of the leg chords of the supporting legs in the prior art spur-gear driven jack-up systems and eliminates the solid toothed racks of expensive, high modulus (e.g., 100 KSI), steel that extend centrally through each leg chord and provides, instead, a leg chord comprising tubular columns with one or more toothed racks of a steel with significantly reduced modulus of elasticity (e.g., 34–58 KSI) welded on their sides, permitting the jack-up leg chords to be reconfigured to have equal or greater section modulus with less cross-sectional area, permitting huge weight and cost savings.

These features eliminate the requirement to use special high-tensile strength (e.g., 100 KSI) steels in the toothed racks and in the plurality of piston-driven rack engagement members. In addition, where the plurality of piston/cylinder units are pivotally mounted to the MODU, the angled substantially planar engagement surfaces of the teeth generate forces resisting the disengagement of the engaged teeth of the rack engagement members and toothed racks when the pistons are substantially retracted within their cylinders to assist in locking the MODU in a stationary position, and the angled substantially planar engagement surfaces of the engaged teeth of the rack engagement members and toothed racks generate forces assisting the disengagement of the teeth for repositioning of the rack engagement members at the end of the pistons' stroke.

In the invention, the plurality of driving piston/cylinder units, for at least each leg, are subjected to the same hydraulic pressure when providing relative motion between the MODU and its supporting legs, and any restriction to movement that may result in the exertion of increased pressure on one set of teeth results in increased pressure on all of the acting cylinders, thereby overcoming the restriction to movement without an excessive and unequal force being exerted against any set of teeth.

As indicated above, the invention further includes a locking mode wherein all of the pistons of the plurality of piston/cylinder units are retracted substantially entirely within their cylinders, with their attached toothed rack engagement members engaged with the toothed racks, and providing, in their engagement, forces resisting their disengagement. The locking mode of operation eliminates the expensive separate locking apparatus for each supporting leg that are necessary in current spur gear driven jack-up systems.

Methods of the invention include:

A method of jacking a MODU without interruption, comprising: providing a plurality of MODU supporting legs; providing a plurality of toothed racks fastened to said plurality of MODU supporting legs; providing a plurality of hydraulic piston/cylinder units attached to said MODU, each of said plurality of hydraulic piston/cylinder units having a toothed rack engagement member attached to and driven in a vertical direction by its piston and engageable with one of said toothed racks; engaging a portion of the plurality of said toothed rack engagement members of a portion of said plurality of piston/cylinder units with said toothed racks; and driving said engaged portion of the plurality of toothed rack engagement member by applying hydraulic pressure to said pistons of said portion of the plurality of piston/cylinder units to extend the pistons and thereby continuously provide relative motion between the MODU and MODU supporting legs while a remainder of the toothed rack engagement members are disengaged from the toothed racks and are being repositioned for re-engagement by applying hydraulic pressure to retract their pistons and thereafter for driving the toothed racks.

A method of locking the MODU in a stationary position, comprising disengaging the toothed rack engagement members of a portion of the plurality of piston/cylinder units from the toothed racks; retracting their pistons substantially entirely within the cylinders of the piston/cylinder units and re-engaging the retracted toothed rack engagement members of said portion of the piston/cylinder units while maintaining engagement of the remainder of the toothed rack engagement members with the toothed racks; and repeating the operation with different portions of the toothed rack engagement members of the plurality of piston/cylinder units until all pistons of the plurality of piston/cylinder units are substantially entirely within their cylinders with all toothed rack engagement members engaged with the toothed racks.

A method of manufacturing a MODU jacking system capable of withstanding at least a maximum leg load of W, comprising: manufacturing a plurality of MODU supporting legs capable of carrying a plurality of toothed racks; selecting a number of toothed racks R and fastening the toothed racks on the plurality of MODU supporting legs; and selecting a number of hydraulic piston/cylinders N, having commercially available diameters d; manufacturing a plurality of rack engagement members capable of engagement with the toothed racks and attaching a rack engagement member to each piston of each hydraulic piston/cylinder; providing a source of hydraulic pressure P on the MODU to provide relative motion between the MODU and the MODU supporting legs by application of hydraulic pressure to the hydraulic piston/cylinders; and fastening said plurality of hydraulic piston/cylinder units to the MODU in a manner permitting engagement of their rack engagement members with the toothed racks, said selection of the number R of toothed racks, the number N of hydraulic piston/cylinders per rack, and the diameter d of the pistons being defined by $$\frac{\pi PRd^2(N-1)}{4} \geq W$$

Further inventive features and combinations are presented in the drawings and more detailed descriptions of the invention that follow.

BRIEF DESCRIPTION OF THE DRAWINGS

FIG. 16 is an illustration of a screen providing a user interface with a jacking system control in this invention.

DETAILED DESCRIPTION OF THE INVENTION

Figure 1:
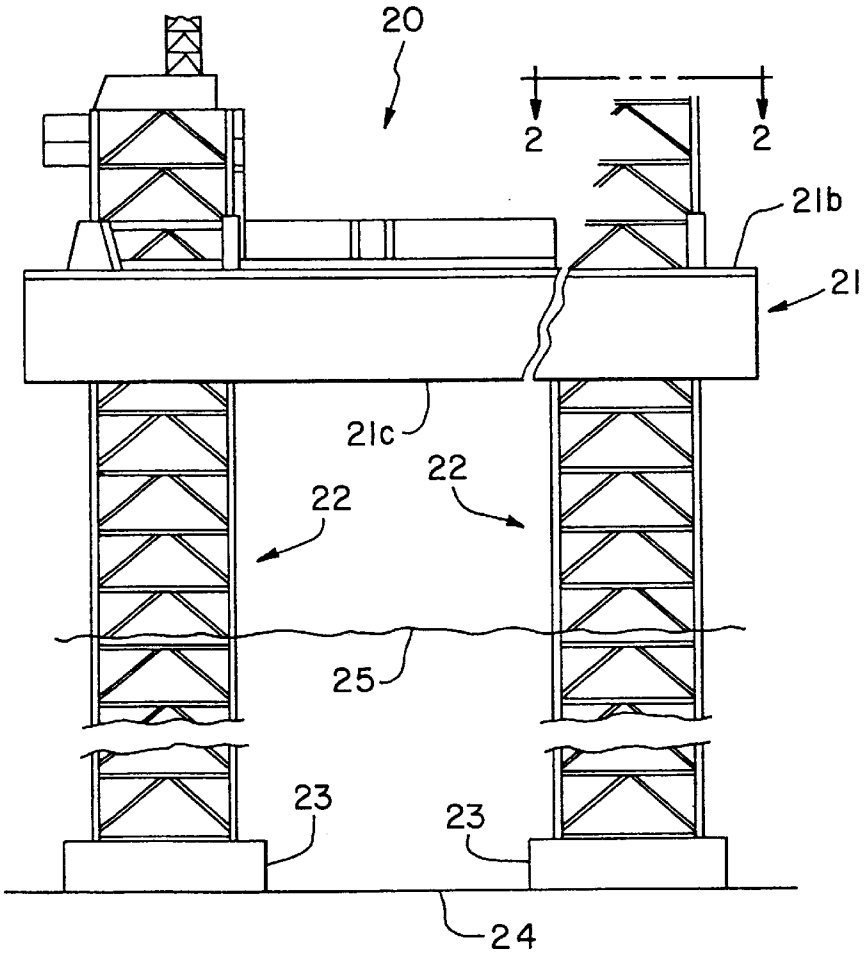
FIG. 1 is a diagrammatic illustration of a jack-up MODU in position offshore.

FIG. 1 illustrates a jack-up MODU 20 at an offshore drilling site. MODU 20 comprises a platform structure 21, and a plurality of MODU supporting legs 22. Jack-up -MODU 20 also includes a jacking system, as described herein, to provide relative motion between the MODU platform 21 and the plurality of supporting legs 22. As illustrated in FIG. 1, MODU platform 21 is supported by the MODU legs 22 from the earth's surface (because of their length, the MODU supporting legs 22 are shown only in part in FIG. 1) substantially above the water level 25.

As constructed and transported, the MODU platform 21 is in a position closely adjacent leg footings 23. The MODU platform 21 is buoyant so the MODU 20 comprises a vessel which can be towed to an exploration site. At the exploration site, the supporting legs 22 are lowered by the jacking system with respect to the platform 21 until the footings 23 reach the earth's surface 24, and the platform 21 is thereafter lifted by the jacking system to a position above the water surface 25.

The invention comprises a novel jacking system to provide relative motion between the MODU platform 21 and its plurality of supporting legs 22, and to lift and lower the massive MODU platform, including all of the supplies, personnel and equipment that it carries, with respect to the earth's surface 24, and to lock the MODU platform 21 in a stationary selected position without the use of any separate locking apparatus. As a result of the inventive features and combinations described herein, the weight of the MODU jacking system components is reduced, the material comprising the leg chords of the supporting legs is reduced, the need for expensive high-strength steels in the jack-up system is eliminated, the capacity of the jacking system for lifting is increased, the need for gear lubrication is eliminated, the cost of the jack-up system and its manufacture is reduced, the loads on each of the supporting legs is readily monitored, and the engineering of the jacking system is substantially simplified.

Figure 2:
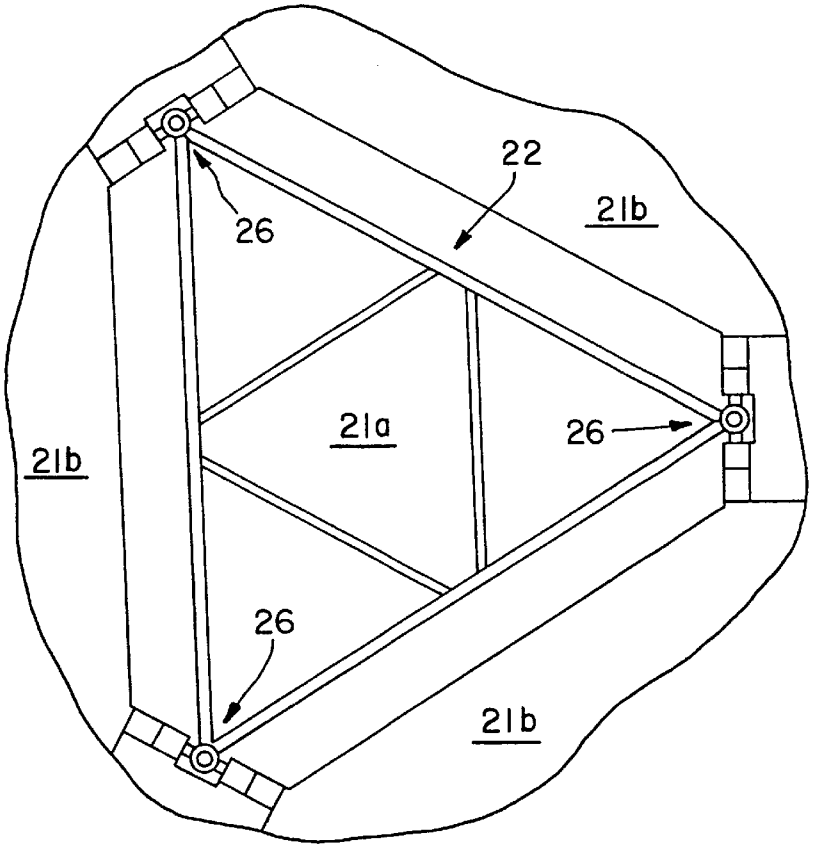
FIG. 2 is a view from above the MODU of FIG. 1, for example, at line 2—2 of FIG. 1, to illustrate the relationship between the MODU platform and its MODU supporting legs.

FIG. 2 is a view from above one of the MODU supporting legs 22 to illustrate how the supporting legs 22 and the MODU platform 21 are movably engaged. As illustrated by FIGS. 1 and 2, each of the plurality of supporting legs 22 can be comprised of three leg chords 26 at the three corners of a triangular-shaped leg support 22. The three leg chords 26 are welded into a supporting leg structure 22 which may be of any configuration that provides sufficient strength to carry the weight of the MODU platform 21 and its top side loads, which may be as much as 20,000 to 30,000 tons. Each of the three supporting legs 22 extend through an opening 21*a* in the decks comprising the MODU platform 21, the upper deck 21*b* being illustrated in FIG. 2.

Figure 4:
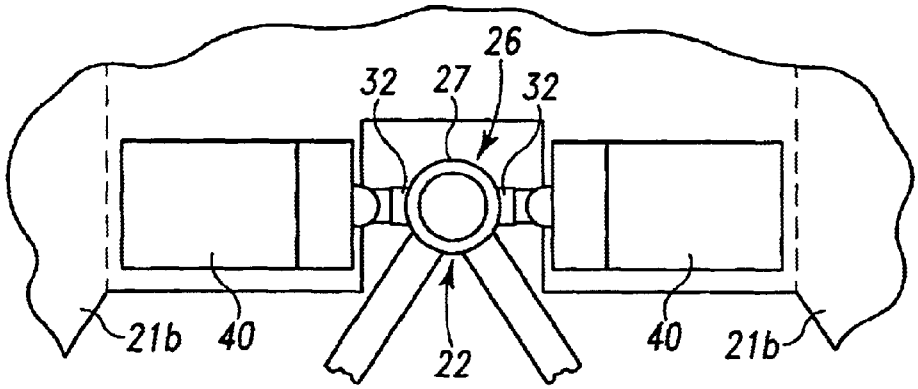
FIG. 4 is a view taken from above FIG. 3.
Figure 3:
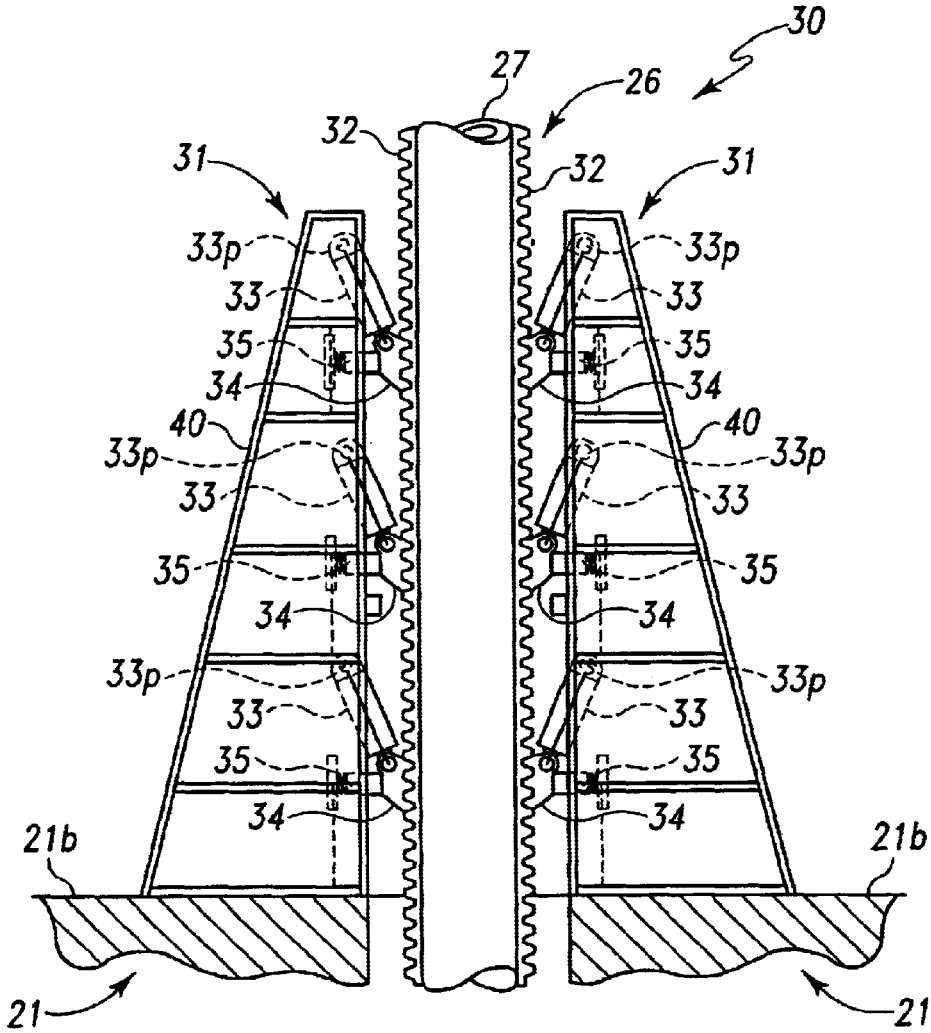
FIG. 3 illustrates a continuous linear motion motor (and its MODU supporting structure) and the engagement of its plurality of piston/cylinder units with a toothed rack and leg chord, with the piston/cylinder units in their locked position.

The leg chords 26 resulting from and making up part of this invention are additionally illustrated on a larger scale in FIGS. 3 and 4.

As best illustrated in FIG. 4, each of the leg chords 26 preferably comprises a cylindrical tubular column 27 with toothed racks 32 welded on opposite sides and positioned for engagement by continuous linear motion motors 30 which operate in the invention to provide continuous relative motion between the MODU platform 21 and the supporting legs 22 and to lock the MODU platform 21 into stationary position with respect to the MODU supporting legs 22. The peripheral outer surface of the cylindrical tubular member 27 of each leg chord 26 of each MODU supporting leg 22 is slidably engaged with bronze bushings (not shown) carried by the MODU platform 21 adjacent its upper deck 21*b* and lower deck 21*c*, and as needed therebetween, to prevent lateral relative motion between the MODU platform 21 and the plurality of supporting legs 22. As a result of the invention, the need for single toothed racks to extend completely through the leg chords of the supporting legs in order to resist the compressive forces imposed by the spur gear drives of the prior art has been eliminated, along with the need to use the expensive, high tensile strength steel, (e.g., 100 KSI), in the leg chords, reducing the weight and cost of each supporting leg. For example, the weight reduction for three supporting legs having lengths of 670 to 680 feet can be as much as 1110 tons, and the cost reduction for three such supporting legs as much as $4,880,000, assuming a cost of $2.20 per constructed pound. Notwithstanding the reduced material of the leg chords 26, as a result of this invention, the leg chords 26 can have an equal or greater section modulus than the prior art systems.

As indicated above, the invention includes a plurality of continuous linear motion motors engaged with the plurality of MODU supporting legs to provide relative motion between the MODU platform 21 and its supporting legs 22. The term "continuous linear motion motor" as used herein refers to a plurality of hydraulic piston/cylinder units N whose piston operations are phased so that N−1 of the plurality of piston/cylinder units are engaged with a MODU-supporting leg 22 and providing relative motion while one of the piston/cylinder units is disengaged from the MODU-supporting leg 22 and is being repositioned for re-engagement with the supporting leg 22 to continue the relative motion. Continuous linear motion motors can comprise any number of piston/cylinder units necessary to provide relative motion between the MODU platform 21 (and its loads) and its supporting legs 22 in acting on one or more toothed racks; however, it is believed to be preferable that the plurality of hydraulic piston/cylinder units in the continuous linear motion motor comprise an even number of units divided into two sets of piston/cylinder units acting on two toothed racks 32 on opposite sides of a leg chord 30, as shown in FIGS. 3–8, to minimize the imposition of transverse shear stresses in the leg chord 26 and toothed racks 32. Toothed racks as used herein means one member or a plurality of members, forming a plurality of tooth engagement surfaces which are capable of accepting the imposition of driving forces sufficient to provide relative motion between a MODU platform 21 and a MODU supporting leg 32. Preferably, toothed racks comprise a plurality of teeth uniformly formed along one side, particularly with a plurality of teeth having angled planar engagement surfaces capable of spreading the stresses due to the driving force necessary for relative motion uniformly throughout the teeth, as described in greater detail below.

Because the number of hydraulic piston/cylinder units that may comprise a continuous linear motion motor is not limited in this invention, it is unnecessary to use expensive specially designed or sized hydraulic piston/cylinder units or hydraulic pumps, and the hydraulic piston/cylinder units and hydraulic pumps may be selected from the inexpensive, commercially available "standard" hydraulic piston/cylinder units and pumps. Continuous linear motion motor jack-up systems of this invention can be made for as much as $2,500,000 less than comparable spur gear driven jack-up systems of comparable lifting capacity.

FIG. 3 illustrates, as an example, a continuous linear motion motor 30 comprising two sets 31 of three piston/cylinder units 33 each to provide continuous relative motion between the MODU platform 21 and the illustrated one of its supporting legs 22. Each of the piston/cylinder units 33 comprises a double-acting hydraulic cylinder, with a piston moving in response to hydraulic pressure applied at the ends of its cylinder to move outwardly from its cylinder and to retract inwardly within its cylinder. FIG. 3 illustrates the pistons of the piston/cylinder units 33 in their retracted position with their pistons substantially entirely enclosed within their cylinders. Each of the pistons of the plurality of piston/cylinder units 33 has a toothed rack engagement member 34 attached to its end and engaged, under the action of an engagement/disengagement means 35, with one of the toothed racks 32, thereby locking the MODU platform 21 in a stationary position with respect to its supporting legs 22. Because, in the invention, the continuous linear motion motors and their pluralities of piston/cylinder units can effectively lock the MODU platform in a stationary position with respect to its supporting legs, the need for the separate expensive platform leg locking apparatus used in the spur gear driven jacking systems is unnecessary, providing a substantial cost savings, for example, about $4,500,000 for a MODU with three MODU supporting legs. The structure of the supporting legs 22, except for the one illustrated leg chord 26 and toothed racks 32, have been omitted from FIG. 3 in order to better illustrate the plurality of cylinders 33 and the engagement of their toothed-rack engagement members 34.

The plurality of piston/cylinder units 33 comprising the continuous linear motion motors 30 that move the supporting leg 22 with respect to the MODU platform 21 are pivotally attached to and carried by structural towers 40 on the MODU platform 21 adjacent the leg chords 26 of the supporting legs. As indicated by the phantom lines in FIGS. 2 and 4, the MODU platform 21 includes structural members, as known in the art, to bear the load associated with the engagement of the MODU platform 21 and its plurality of supporting legs 22.

The continuous linear motion motor 30 includes a plurality of means 35 for engagement and disengagement of the toothed shoes 34 of the piston/cylinder units 33 with the toothed racks 32 by pivoting the piston/cylinder units 33 through a small angle. The engagement/disengagement means 35 for the rack engagement members 34 preferably comprise compression springs 36 that act on the rack engagement members 34 to urge them toward and into engagement with the toothed racks 32, as shown in FIG. 3A, and unclamp hydraulic piston/cylinder units 37 that act in response to the imposition of hydraulic pressure within their cylinders to overcome the forces of the compression springs 36, moving the rack engagement members 34 away from and disengaged from the toothed racks 32. Such engagement/disengagement means 35 preferably comprise single-acting piston/cylinder units including the compression spring 36 within the cylinder acting on one side of the piston to push it outwardly from the cylinder in absence of pressure, with the application of pressure on the other side of the piston overcoming the force of the compression spring and moving the piston into the cylinder. With such preferred engagement/disengagement means, no power is required to engage and maintain the engagement of the toothed rack engagement member 34 with the toothed racks 32 in the locked mode; however, other controllable engagement/disengagement means, such as double acting hydraulic piston/cylinders, electric actuators and the like, may be used.

As described in greater detail below, the tooth profiles of the teeth of the toothed shoes 34 and of the teeth of the toothed racks 32 and the pivotal attachment of the cylinders 33 cooperate when the jacking system is in its locked mode with the pistons of piston/cylinder units 33 retracted into their cylinders to generate engagement forces assisting the engagement/disengagement means 35 in maintaining the toothed shoes 34 in engagement with the toothed racks 32 and maintaining the MODU platform 21 locked into a stationary position with respect to its supporting legs 22.

To simplify explanation of the operation of continuous liner motion motors two sets of three active hydraulic piston/cylinder units 33 are illustrated and described as comprising a continuous linear motion motor 30. It must be understood, however, that any plurality of piston/cylinder units N may comprise a continuous linear motion motor in the invention, provided their operation is sequentially phased, as, for example, illustrated in FIGS. 9 and 10, so that N−1 of the piston/cylinder units are engaged with a toothed rack and are providing relative motion between the MODU 21 platform and the MODU supporting legs 22 while one of the piston/cylinder units is being retracted and repositioned for reengagement with and driving of the supporting leg.

FIGS. 5–9 illustrate the phased operation of the three piston/cylinder units 33*a*, 33*b* and 33*c* of each set 31 to provide continuous linear motion acting on a leg chord 26 of one of the MODU supporting legs 22.

In providing continuous linear motion, the piston strokes of each of the piston/cylinder units 33*a*, 33*b* and 33*c* of each set 31, and the engagement and disengagement of their toothed rack engagement means 34 are phased, that is, their operations are displaced in time so that two of the piston/cylinder units have their rack engagement members 34 engaged with the toothed racks 32 of a leg chord 26 with their pistons being extended to drive the leg chord 26 while the third piston/cylinder unit has its rack engagement member 34 disengaged from the toothed rack 32 of the leg chord 26 with its piston being retracted to reposition its rack engagement member 34 for reengagement with the toothed rack 32 and subsequent extension of its piston to drive the leg chord 26. This repetitive phased operation of the piston/cylinder units 33 to achieve linear motion is illustrated in the phase diagram FIG. 9.

Figure 5:
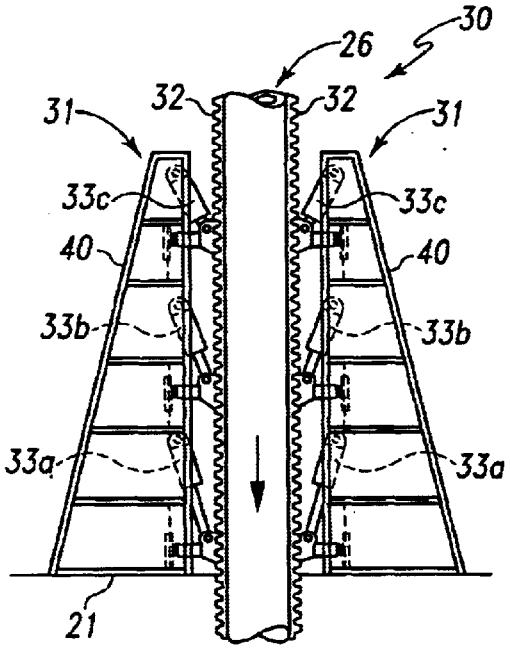
FIGS. 5–9 illustrate the phased operation of two sets of three hydraulically driven piston cylinder units to effect continuous linear motion, FIG. 9 comprising a phase diagram for the operations of the pistons as illustrated by FIGS. 5–8.
Figure 6:
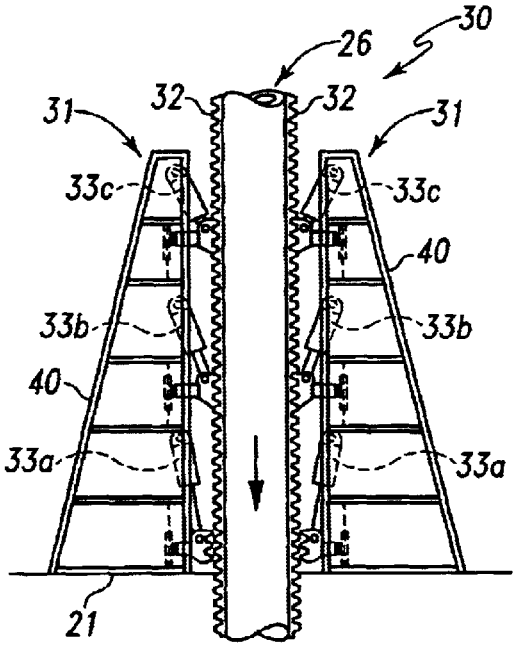
Figure 7:
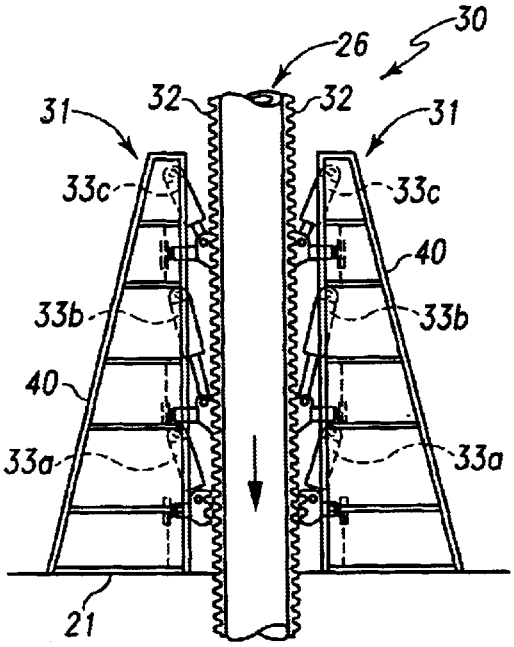
Figure 8:
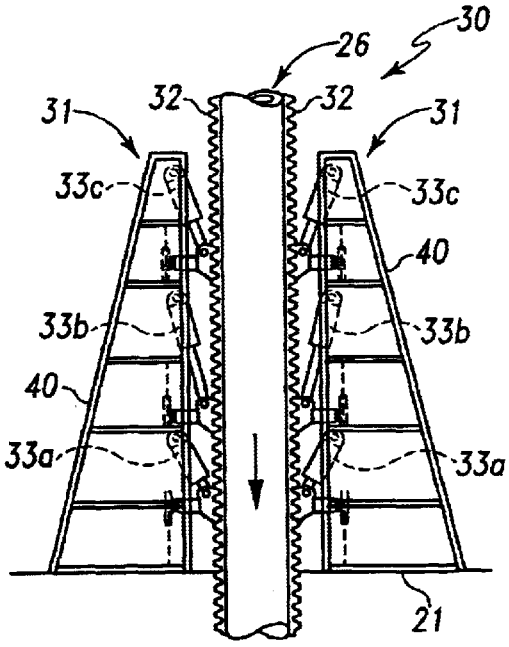
Figure 9:
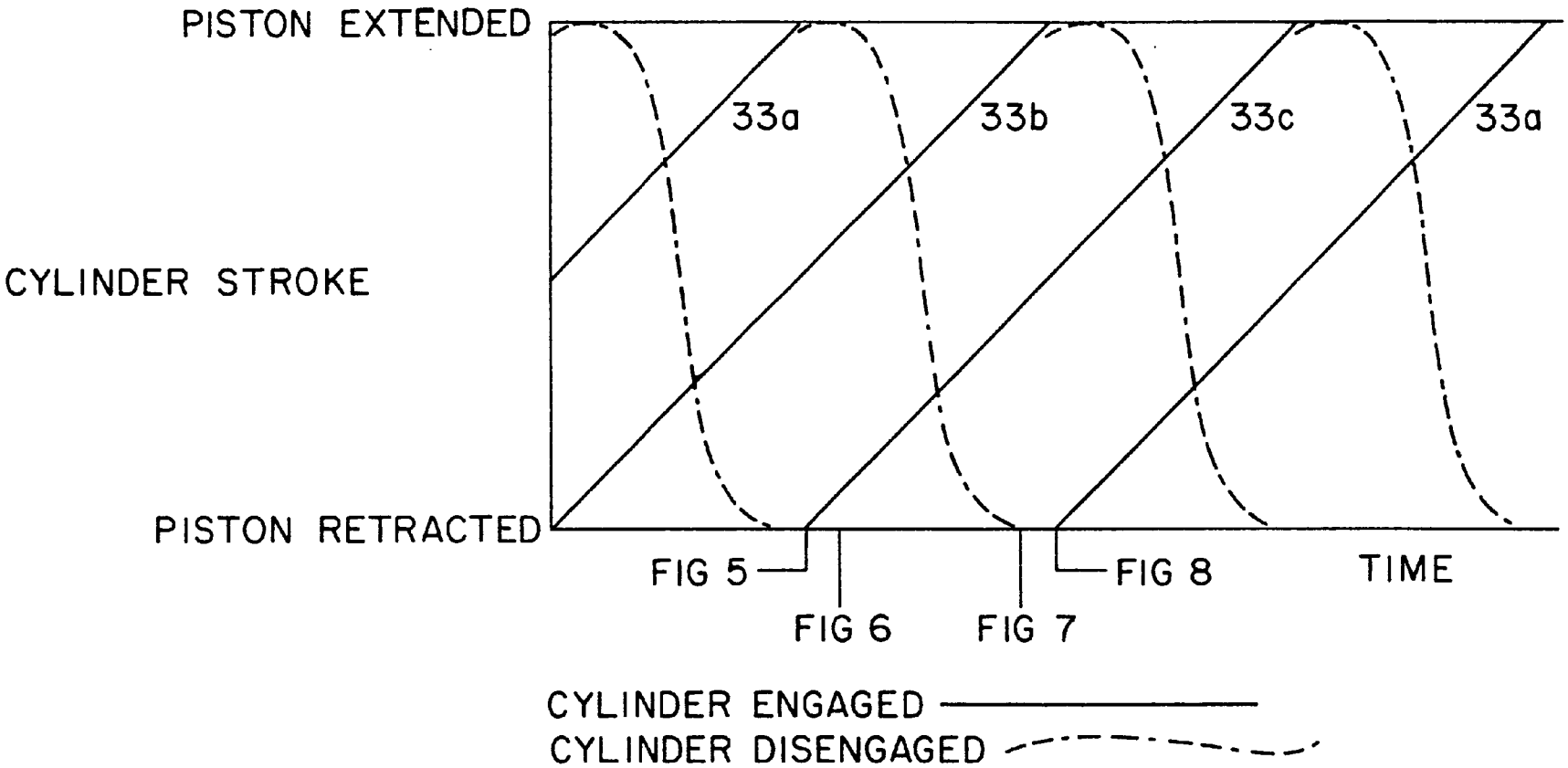

At the point in time illustrated on FIG. 9 by the notation FIG. 5, the piston/cylinder units 33*a*, 33*b* and 33*c* have been driven so the pistons of piston/cylinder units 33*a* are fully extended, the piston/cylinder units 33*b* are in mid-stroke, and the piston/cylinder units 33*c* have just been engaged with toothed racks 32. At the point in time illustrated by FIG. 6 on the phase diagram of FIG. 9, the rack engagement members 34 of piston/cylinder units 33*a* have been disengaged from the toothed racks 32, while piston/cylinder units 33*b* and 33*c* continue to drive toothed racks 32 and leg chord 26 to the point illustrated in FIG. 7. At the point in time illustrated by FIG. 7, the pistons of piston/cylinder units 33*a* have been retracted and the rack engagement members 34 of piston/cylinder units 33*a* have been positioned for reengagement with the toothed racks 32, the piston/cylinder units 33*b* have been operated until their pistons are fully extended and the piston/cylinder units 33*c* have been operated until their pistons are in mid-stroke. Shortly after this time, as illustrated in FIG. 8, the rack engagement members 34 of piston/cylinder units 33*a* are reengaged with the toothed racks 32 as the pistons of piston/cylinder units 33*b* approach full extension and as the pistons of piston/cylinder units 33*c* are in mid-stroke. This phased operation of the toothed rack engagement members 34 by their engagement/disengagement means 35 and of the pistons of piston/cylinder units 33*a*, 33*b* and 33*c* continues in time, as indicated by FIG. 9, continuously driving (without interruption) the MODU supporting legs 22 with respect to the MODU platform 21.

Figure 10:
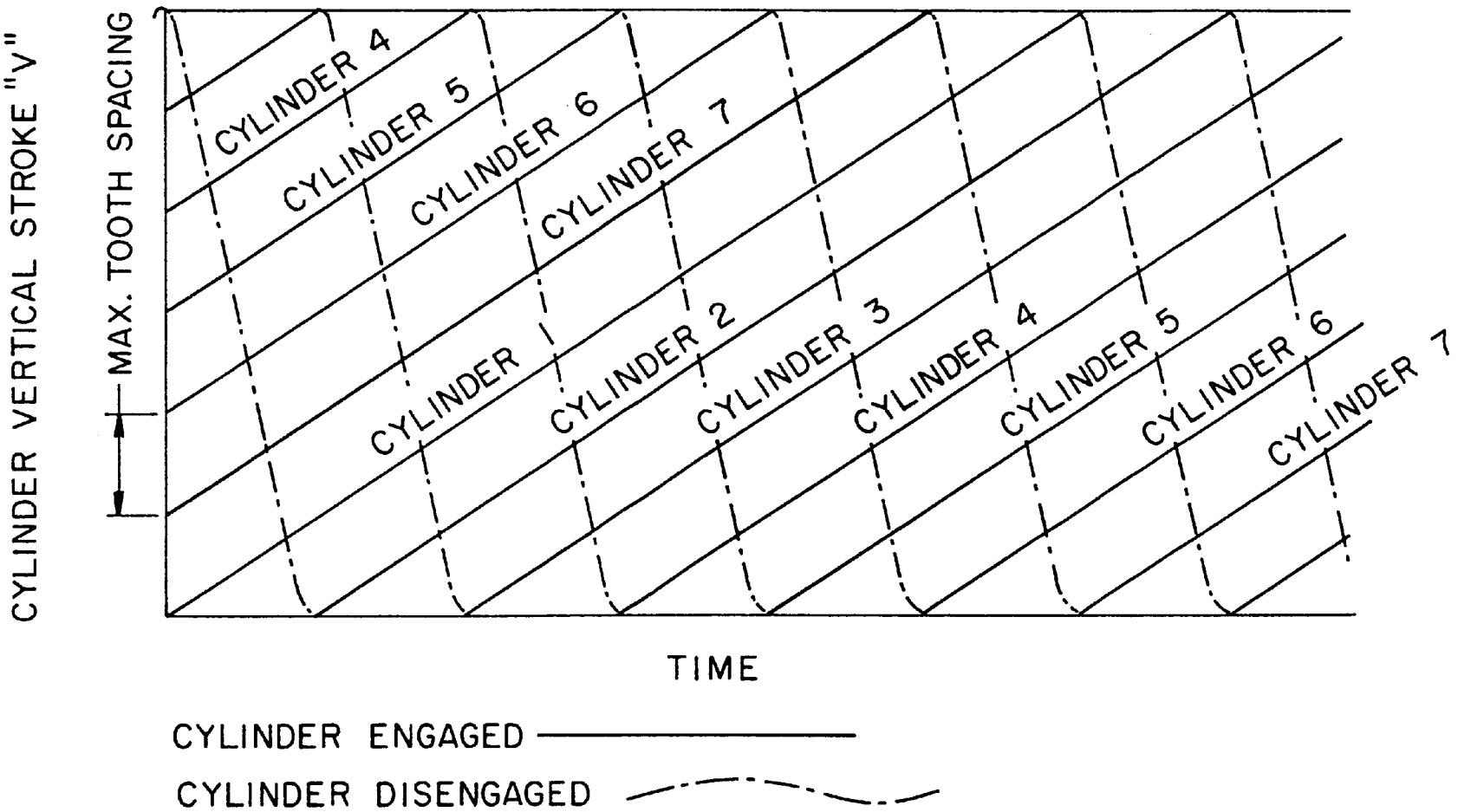
FIG. 10 is a phase diagram of seven piston/cylinder units operating to provide continuous linear motion.

As indicated above, it is not necessary that the continuous linear motion motors comprise sets of three piston/cylinder units, and in practical application, because of the substantial forces that are required to move the massive weights of a MODU platform and the loads that it carries, and MODU supporting legs with respect to each other, continuous linear motion motors incorporated into MODU jacking systems will comprise substantially more than three piston/cylinder units each. FIG. 10, for example, comprises a phase diagram of the operation of a seven piston/cylinder unit motor. With larger numbers of piston/cylinder units in a motor, the stress created in the teeth of the jack-up system and the time during which any single piston/cylinder unit is disengaged from the supporting legs is reduced. In addition, although FIGS. 3–8 illustrate an even number of piston/cylinder units 33 acting in pairs on the opposing toothed racks 32 of a leg chord 26, the number of piston/cylinder units acting on the toothed racks of a single leg chord can be an odd number, so long as the number of piston/cylinder units N are phased so that N−1 piston/cylinder units are engaged with and driving the leg chords of the MODU supporting leg while one of the piston/cylinder units is being retracted for subsequent engagement. Where an odd number of piston/cylinder units is engaged with the toothed racks of a single leg chord, their positions of engagement with the toothed racks of the leg chords should be staggered, rather than opposing, as illustrated in FIGS. 3–8. While the staggered odd number of piston/cylinder units acting on toothed racks imposes shear forces acting transversely on the toothed racks and leg chord, the forces acting normal to the central axis of the leg chord and its toothed racks are not large and will impose no unacceptable shear stress on the toothed racks and leg chord.

Figure 11:
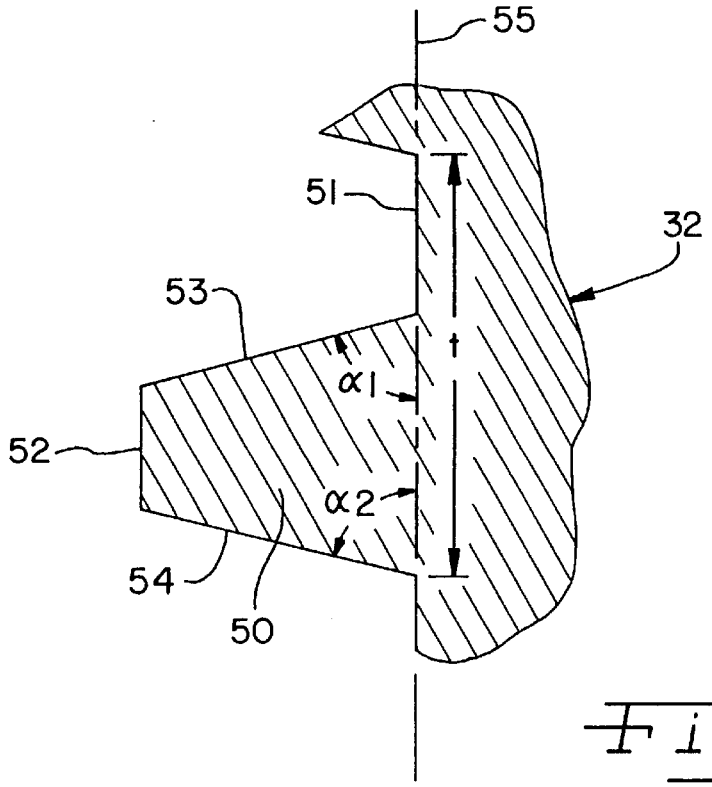
FIG. 11 is a cross-sectional illustration of a preferred tooth profile of the invention.

Another feature of the invention comprises the tooth profile preferably employed in the rack engagement members 34 and the toothed racks 32. FIG. 11 illustrates, in cross section, a tooth 50 with a profile that is preferably incorporated into the teeth of the rack engagement members 34 and toothed racks 32. While the preferred tooth 50 is illustrated in FIG. 11 as one of the teeth of the toothed rack 32, the mating teeth of the toothed rack engagement members 34 will have the same mating tooth profile. In practice the toothed racks are wide, having widths, for example, of 7–10 inches, and the load bearing surfaces of the tooth 50 extend in directions perpendicular to the surface of the paper.

As indicated by FIG. 11, the tooth profile of a preferred tooth 50 includes flat and substantially vertical root and cap surfaces 51 and 52, respectively, and a pair of angled planar engagement surfaces 53 and 54, forming with respect to a substantially vertical plane 55 that includes the roots 51 of the teeth, tooth angles $\alpha 1$ for the planar upper tooth surface 53 and $\alpha 2$ for the lower planar tooth surface 54. While it is preferable that the tooth engagement surfaces 53 and 54 of tooth 50 be purely planar, manufacturing techniques, such as the use of cutting torch methods, introduce deviations from the preferred purely planar form. Further references to the "planar" surfaces of the tooth 50 include surface imperfections and variations from purely planar that do not alter the reduced stress concentration benefits of this invention. For ease of manufacture, the angles $\alpha 1$ and $\alpha 2$ are preferably equal angles, although the angle of $\alpha 2$ of the lower engagement surface 54 may be increased to decrease the disengagement forces when the supporting legs 22 and their inner racks 32 are moved upwardly with respect to the MODU platform 21. Importantly, the angle $\alpha 1$ for the upper planar engagement surfaces 53 of the toothed racks 32 is selected so that when the mating teeth of the rack engagement members 34 are being driven by the piston/cylinder units 33 in mid-stroke, the forces imposed on the upper angled planar engagement surfaces 53 of the toothed racks 32 by the mating engaged teeth of the rack engagement members 34 is substantially perpendicular to the upper planar engagement surfaces 53 of the rack teeth 50. Because the engagement surfaces of the teeth of the rack engagement members 34 and the engagement surfaces of the teeth of the toothed racks 32 are planar, the stresses resulting from the driving forces on the engaged teeth of the rack engagement members 34 and toothed racks 32 are uniformly spread over the engaged surfaces and within the bodies of the teeth.

As well known in the art, the number of toothed racks and engaged teeth necessary to carry the maximum weight W of the MODU platform and all of its topside loads may be determined by $$S \times T \times N \geqq W$$

where S is the acceptable tensile stress of the material from which the engaged teeth will be manufactured, T is the total root area of the engaged teeth of each toothed rack and N equals the number of toothed racks. The total root area T equals the tooth pitch t (FIG. 11) of the engaged teeth times the number n of the engaged teeth (i.e., t×n). The total root area T may comprise as large an area as necessary to permit the use of readily available and inexpensive steels having modulii of elasticity, for example, on the order of 34–58 KSI, thereby eliminating the requirement for use of the special high strength steels required by the spur gear drive systems of the prior art.

In a continuous linear motion motor the geometric relationship of tooth pitch, vertical cylinder stroke, vertical distance between base mounting pins of cylinders, number of cylinders used, and cycling arrangement must meet certain geometric criteria for satisfactory operation. When configured as described below, the jacking operation will move the legs of the jack-up rig up or down in relationship to the jack-up platform and will lock the legs in position for extended periods for drilling operations or for transit.

A typical calculation to determine the geometry of a specific jack-up design follows:

| Typical Calculation | Example |
|---|---|
| Step 1: Calculate the total number of cylinders required at each leg to raise the jack-up platform, including safety factor. The number of cylinders must be evenly divisible by the number of leg chords. This result must be the next higher even number. | 54 cylinders in sets of 2 |
| Step 2: Divide the number of cylinders by the number of leg chords. (9 leg chords for 3 triangular legs) | 54/9 = 6 In sets of 2 |
| Step 3: Add one set of cylinders per leg chord | 6 + 1 = 7 sets of cylinders per leg chord |
| Step 4: Select the desired tooth pitch "T" by calculating acceptable bearing stresses on the leg chord teeth. | 3 inch pitch |
| Step 5: Multiply the tooth pitch "T" by the number of cylinders on each leg chord to find "V". | V = T * 7<br>V = 3 * 7<br>V = 21 inches |
| Step 6: Calculate "D" by subtracting maximum tooth pitch from the vertical travel of the tooth engaged with the chord rack. | D = V − T<br>D = 21 − 3<br>D = 18 inches |
| Step 7: The piston travel S is then determined from the result and the mounting geometry. | |

Let:

N = number of cylinders (or cylinder pairs) required at each leg chord to raise the jack-up platform;

V = vertical travel of the tooth (or teeth) engaged with the chord rack;

D = vertical distance between base pins of cylinders, i.e., mounting distance;

T = required tooth pitch of rack;

t = individual tooth pitches smaller than required tooth pitch may be attained by dividing "T" by 2, 3, 4, etc.;

S = cylinder stroke.

Since the cylinder may be mounted with the cylinder base pin outboard from the rod end pin, "S" will be larger than "V".

FIG. 10 illustrates the correlation between the vertical cylinder stroke V and the maximum tooth pitch, or spacing T for a seven piston/cylinder unit motor.

Other possibilities exist for determining numbers of cylinders or for determining workable tooth pitch "t". Odd numbers of cylinders may be advantageous for some designs which will require the cylinders to act individually and alternately along the leg chord with the mounting of the cylinders determined in a similar manner as described in the above calculation to establish the proper geometry for cylinder position and tooth pitch.

The following table further illustrates the relationship between the number of phased piston/cylinder units and tooth spacing.

SYSTEM PHASE VS. TOOTH SPACING

| SYSTEM PHASE | 120 DEGREE | 90 DEGREE | 72 DEGREE | 60 DEGREE |
|---|---|---|---|---|
| NO. CYL. OR CYL. PAIRS - N | 3 | 4 | 5 | 6 |
| VERTICAL STROKE - V | V | V | V | V |
| MAX TOOTH SPACING - T | V/(N − 1) | V/(N − 1) | V/(N − 1) | V/(N − 1) |

For smaller teeth, the maximum tooth spacing T can be divided by a whole number, e.g., 2 or more, to obtain t.

Furthermore, as indicated above, the angled planar tooth surfaces 53 of the preferred teeth in combination with the pivotal mounting of the driving piston/cylinders 33 permit the generation, by the engaged teeth of the rack engagement members 34 and toothed racks 32, of forces that resist disengagement of the rack engagement members 34 from the toothed racks 32 when the piston/cylinder units 33 are in their retracted positions in the locking mode of operation of the system, and forces assisting disengagement of the rack engagement members 34 from the toothed racks 32 when the piston/cylinder units 33 are fully extended and ready for disengagement and repositioning during their operation in the jack-up or jack-down modes.

Figure 12:
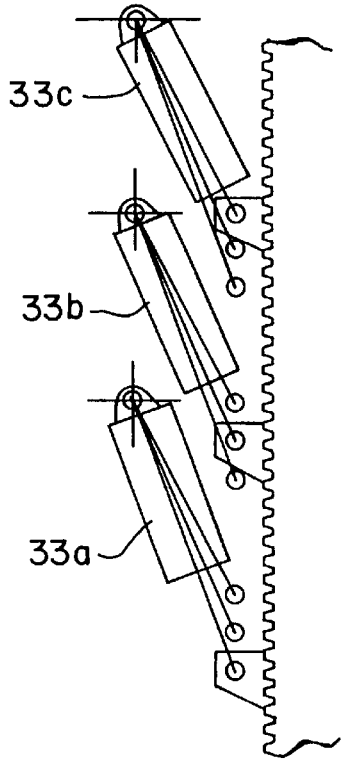
FIGS. 12–15 diagrammatically illustrate how the pivotal attachment of a driving piston/cylinder unit to the MODU combines with the preferred tooth profile of FIG. 11 to provide an application of driving force uniformly and normally on the teeth with the piston at mid-stroke (FIG. 14), and to generate forces resisting the disengagement of the teeth when the pistons are retracted and the MODU is in its locking mode (FIG. 13), and to generate forces assisting the disengagement of the teeth when the pistons are at the end of their stroke (FIG. 15)
Figure 15:
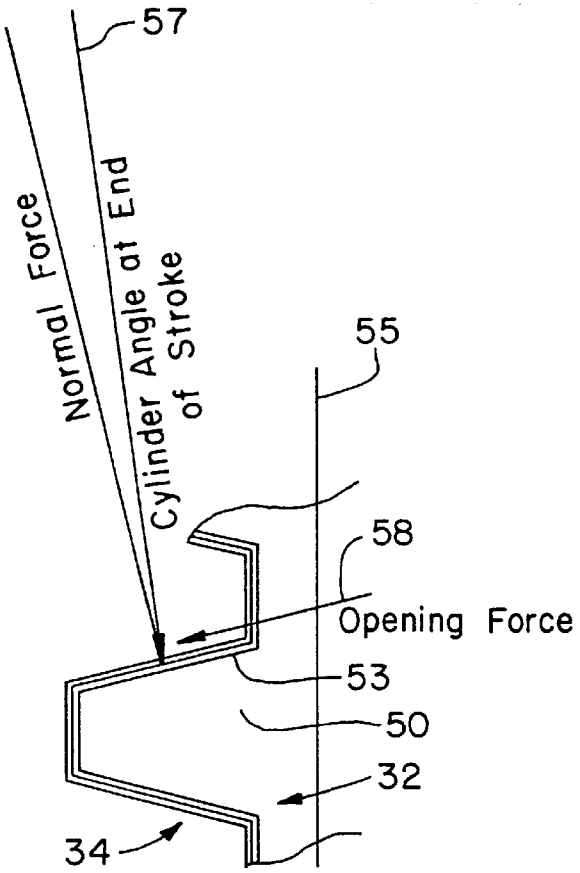
Figure 14:
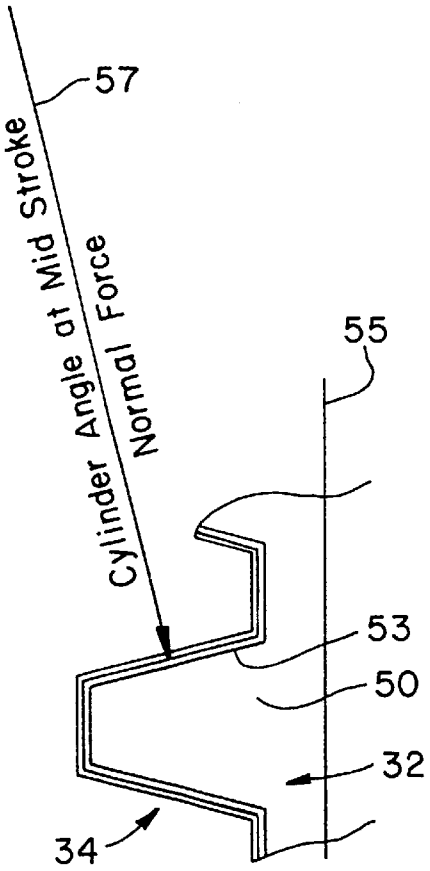
Figure 13:
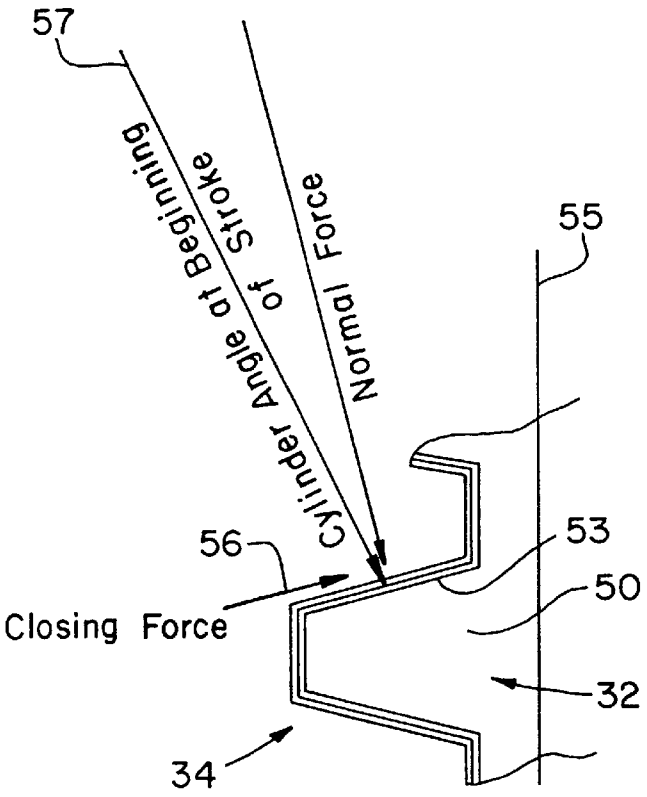

The cooperation of the angled planar tooth engagements surfaces 53 of the preferred teeth 50 with the pivotal attachment of the piston/cylinder units 33 is illustrated in FIGS. 12–15. FIG. 12 illustrates three piston/cylinder units 33*a*, 33*b*, and 33*c* with their pistons fully extended, at mid-stroke and fully retracted respectively, and FIGS. 13, 14 and 15 illustrates the force vectors at the engaged planar tooth engagement surfaces 53 of the toothed racks 32, with FIG. 13 representing the force vectors corresponding to the position of piston/cylinder units 33*c*, FIG. 14 representing the force vectors corresponding to the position of piston/cylinder units 33*b*, and FIG. 15 representing the force vectors corresponding to piston/cylinder units 33*a*.

As shown in FIG. 13 with the pistons of the piston/cylinder units retracted (as with piston/cylinder unit 33*c* of FIG. 12) and the preferred teeth 50 of the toothed rack engagement members 34 and the toothed racks 32 engaged, a closing force vector 56 is generated urging the toothed rack engagement members 34 toward the toothed racks 32 to assist in maintaining their engagement and in locking the MODU platform 21 in a stationary position with respect to the MODU supporting legs during the locking mode of the jacking system.

As shown in FIG. 14, when the piston/cylinder units are in mid-stroke (as with the piston/cylinder unit 33*b* of FIG. 12), the force vector 57 resulting from the pistons of the piston/cylinder units is perpendicular to the planar engagement surfaces 53 of the toothed racks 32.

As shown in FIG. 15 with the pistons of the piston/cylinder units fully extended (as with the piston/cylinder unit 33*a* of FIG. 12) an opening force vector 58 is generated urging the toothed rack engagement members 34 away from the toothed racks 32. The opening force 58 must be resisted by the compression springs of the preferred engagement/disengagement means 35 but will assist in the disengagement of the toothed rack engagement members 34 prior to their retraction and re-engagement.

As the MODU platform 21 is lowered in the jack-down mode at a rate controlled by the plurality of piston/cylinder units 33, the upward forces generated by the resistance of the pistons in controlling the lowering of the MODU platform 21 will generate, by the engagement of the lower angled toothed surfaces 54 of the toothed racks 32 with the corresponding mated surfaces of the rack engagement members 34, an opening force (like force 58) acting to disengage the rack engagement members 34 from the toothed racks 32, and such forces must be overcome by the forces exerted by the compression springs of the engagement/disengagement means 35 that maintain the rack engagement members 34 in engagement with the toothed racks 32. These opening forces acting to disengage the rack engagement members 34 from the toothed racks 32 as the MODU is lowered can be reduced by increasing the tooth angle $\alpha 2$ of the lower planar engagement surfaces to be, for example, more substantially normal to the vertical plane 55.

The hydraulic system will, preferably, use a pressure compensated variable volume hydraulic pump or pumps for generation of the hydraulic pressure, enabling the speed of movement of the pistons to be controlled. In addition, over center valves may be used to require the presence of positive hydraulic pressure at the cylinders before the pistons are moved in the jack down mode. The jacking system will, as apparent to those skilled in the art, also include the controllable hydraulic valves necessary to control the sequenced application of hydraulic fluid and pressure to the piston/cylinder units 33 and the unclamping piston/cylinder units of the preferred engagement/disengagement means 35, accumulators, if needed, to accelerate the operation of the pistons of the piston/cylinder units 33, and direction flow valves, relief valves, load cells and motion sensors, as needed.

As noted above, the piston/cylinder units of the continuous linear motion motors for each supporting leg can be connected to a common hydraulic fluid supply line so that the same hydraulic pressure is exerted on all the piston/cylinder units acting on that leg. Thus, any resistance to movement of one leg chord of a supporting leg will increase the pressure and forces acting on all of the leg chords of the supporting leg and tend to maintain uniform motion of all of the leg chords.

The invention thus provides a new jack-up MODU and MODU jacking system that can reliably handle loads several times greater than can be currently handled, can be readily and inexpensively designed and scaled for different jack-up loads, and can save millions of dollars in the manufacture of a single jack-up MODU.

The jacking system of the invention provides, as indicated above, jack-up, jack-down and locking modes of operations and permits monitoring and control of leg loads and the rates of relative movement. Operation of the jacking system, in the invention, is preferably controlled by a programmable logic computer, which can control operation of one or a plurality of sources of hydraulic pressure, operation of each of the continuous linear motion motors driving each of the toothed racks of each of the supporting legs by sequencing the operations of valves controlling the flow of hydraulic fluid and the application of hydraulic pressure to the piston/cylinder units of the motors, and by controlling the rates of relative motion. The computer control can also sequence operation of the valves and piston/cylinder units to position the pistons and toothed rack engagement members of the continuous linear motion motors for providing motion, in changing from the locking mode to the jack-up or jack-down modes, and can cease motion of the pistons of the piston/cylinder units of the continuous linear motion motors and sequentially retract their pistons and engage their rack engagement members in changing from the jack-up or jack-down modes to the locking mode.

Figure 3B:
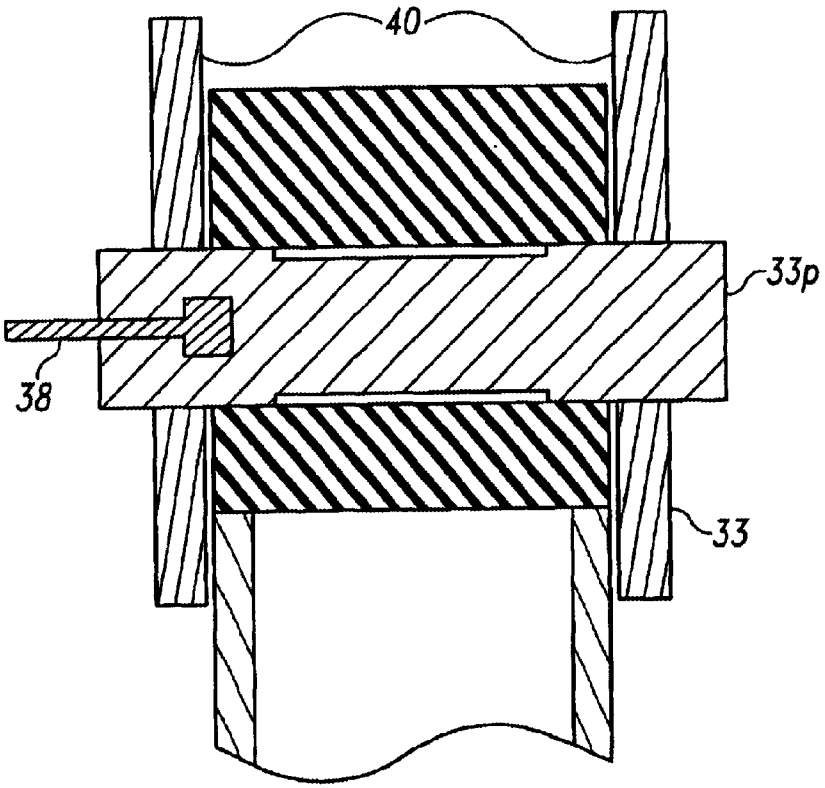
FIG. 3B is a partial cross-sectional view of FIG. 3A taken at a plane 3B—3B through the central axis of a pivot pin of a piston/cylinder unit to illustrate a load sensor included in the pivotal attachment of the piston/cylinder unit of FIG. 3A.
Figure 3A:
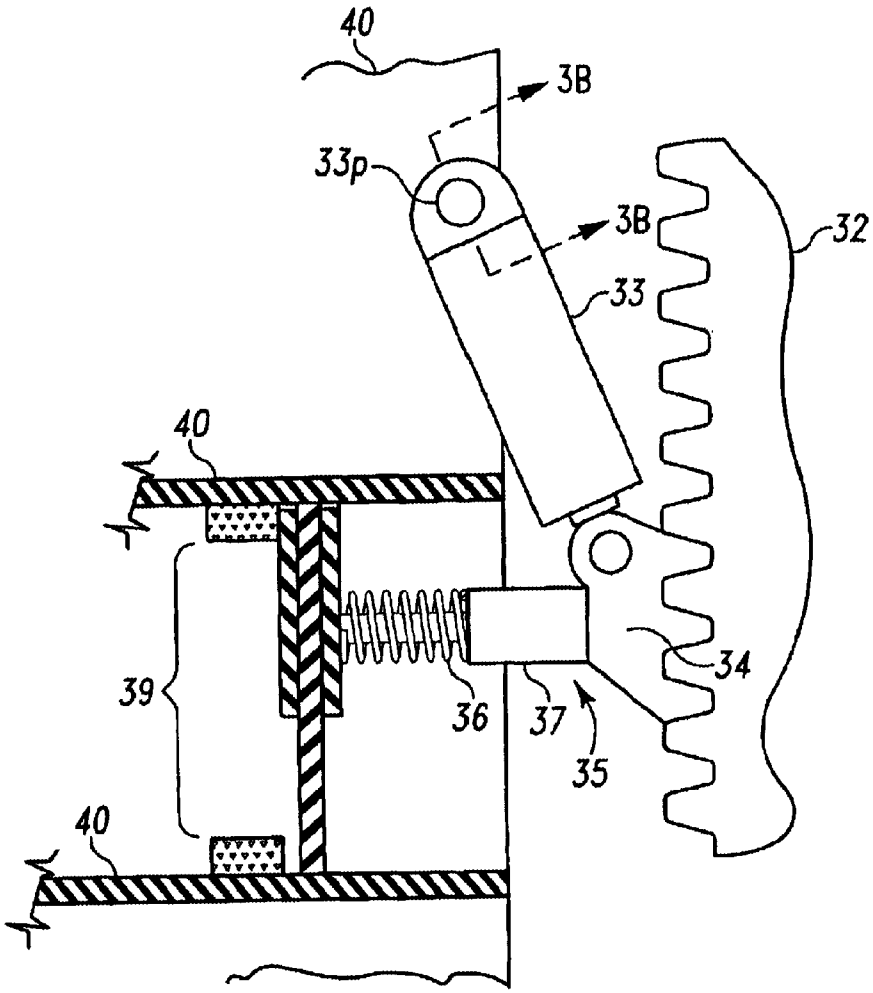
FIG. 3A illustrates one of the piston/cylinder units of FIG. 3 with its rack engagement member engaged with the toothed rack through the action of a compression spring, and also illustrates a motion sensor for sensing the relative rate of movement of a MODU supporting leg.

In addition, the computer control can also monitor the output signals of load cells 38 located in the pivot attachments 33*p* of the plurality of piston/cylinder units 33, as shown in FIG. 3B, for sensing the loads on each of the leg chords of each of the supporting legs and/or outputs of motion sensors 39 for sensing the rate of movement of each of the leg chords of each of the supporting legs, as shown in FIG. 3A, and can provide quantitative read-outs thereof and warnings of unacceptable operating conditions.

FIG. 16 illustrates one possible screen presentation 60 of such a computer control, which provides touch screen selection of the modes of operation of each supporting leg, quantitative presentations of the jacking speed, the hydraulic pressure acting on each supporting leg and the load imposed on each supporting leg. In such a screen presentation, the representations of the legs can change color or flash with or without an audible noise, to warn of an unacceptable operating condition.

The description and illustrations of the invention presented here are of specific preferred embodiments and simplified examples. As will be apparent to those skilled in the art, the invention is not limited to the specific embodiments described and illustrated, but is defined in its scope by the following claims.

What is claimed is:

1. A MODU jacking system for providing relative motion between a MODU platform and a MODU supporting leg having at least one leg chord with at least one toothed rack, comprising at least three piston/cylinder units for said at least one toothed rack, each of the at least three piston/cylinder units having an extendable and retractable piston and a toothed rack engagement member driven by its piston;

at least three engagement/disengagement means for engaging and disengaging the toothed rack engagement members of the at least three piston/cylinder units with the toothed rack;

a source of hydraulic pressure for driving the pistons of the at least three piston/cylinder units; and control means for operating said at least three piston/cylinder units and said at least three engagement/disengagement means, said control means providing a continuous relative motion between the MODU platform and the MODU supporting leg during jacking operations by operating a portion of the at least three engagement/disengagement means and engaging a portion of the toothed rack engagement members of a portion of the at least three piston/cylinder units with the toothed rack, and operating said engaged portion of the at least three piston/cylinder units to provide said continuous relative motion while operating one of the at least three the engagement/disengagement means and disengaging the toothed rack engagement member of one of the at least three piston/cylinder units and operating the disengaged one of the at least three piston/cylinder units to reposition the disengaged toothed rack engagement member for re-engagement with the toothed rack and providing said continuous relative motion.

2. The MODU jacking system of claim 1, wherein the engaged operating times of each of the at least three piston/cylinder units are offset from the engaged operating times of the other piston/cylinder units so that at least two piston/cylinder units are driving engaged toothed rack engagement means, while at least one piston is retracting to position its toothed rack engagement means for re-engagement with the toothed rack.

3. The MODU jacking system of claim 1, wherein said at least three piston/cylinder units for said at least one toothed rack comprises N units, where N is three or more, and wherein operation of the pistons of said N units is phased so that N−1 units are engaged with and providing relative motion at all times during jacking operations while one of said N units is disengaged from the toothed rack and is being retracted.

4. The MODU jacking system of claim 1, wherein the engagement/disengagement means comprise compression springs acting to urge the toothed rack engagement members generally horizontally into engagement with the toothed racks, and unclamping piston/cylinder units operable by hydraulic pressure to pull and disengage the toothed rack engagement members from the toothed rack.

5. The MODU jacking system of claim 1 wherein the MODU platform and MODU supporting leg are locked in a stationary position by said control means ceasing said continuous relative motion, disengaging a portion of the engaged toothed rack engagement members of said engaged portion of the at least three piston/cylinder units from the toothed rack while maintaining engagement of the remainder of the toothed rack engagement members with the toothed rack, and operating said disengaged portion of the piston/cylinder units to retract their pistons substantially entirely within their cylinders, and re-engaging the retracted toothed rack engagement members of said disengaged portion of the piston/cylinder units with the toothed rack, and repeating the operation with different portions of the toothed rack engagement members and of the at least three piston/cylinder units until all pistons of the at least three piston/cylinder units are substantially entirely within their cylinders with all toothed rack engagement members engaged with the toothed racks.

6. The MODU jacking system of claim 5 wherein said engagement/disengagement means for each toothed rack engagement member comprises a compression spring urging each toothed rack engagement member into engagement with the toothed rack, and wherein no power is expended in maintaining the MODU locked in said stationary position.

7. The MODU jacking system of claim 5, wherein said piston/cylinder units of said at least three piston/cylinder units are pivotally attached at their cylinder ends to the MODU platform, said engagement/disengagement means pivoting said piston/cylinder units during their operation; said at least one toothed rack has a plurality of teeth with angled planar engagement surfaces, and said toothed rack engagement members have a plurality of teeth with mating angled planar engagement surfaces; said plurality of angled planar engagement surfaces of said toothed racks and said toothed rack engagement members generating in their engagement, forces resisting the disengagement of the toothed rack engagement members, with the pistons in their retracted positions.

8. The MODU jacking system of claim 5 wherein said engagement/disengagement means of each toothed rack engagement member comprises a hydraulic piston/cylinder attached to disengage the toothed rack engagement member from the toothed rack, and a compression spring acting on the toothed rack engagement member to urge the toothed rack engagement member into engagement with the toothed rack.

9. The MODU jacking system of claim 1 wherein said control means operates said at least three piston/cylinder units and said at least three engagement/disengagement members to provide a MODU jack up cycle, a MODU jack down cycle, and a MODU position locking cycle.

10. The MODU jacking system of claim 9 wherein, upon receiving an operator input to move from the MODU position locking mode to either of the MODU jack up and MODU jack down modes, said control automatically operates a sequential disengagement and positioning of portions of the toothed rack engagement members for phased operation to provide said relative motion.

11. The MODU jacking system of claim 9 wherein at least one of the at least three piston/cylinder units is carried by the MODU platform with a load sensor, whose output is monitored by the control and provides indicia of the load conditions and a warning of unacceptable load conditions.

12. The MODU jacking system of claim 1 wherein said at least one leg chord comprises a tubular column with said at least one toothed rack welded on the side of the tubular column.

13. A MODU jacking system for providing relative motion between a MODU platform and a MODU supporting leg having at least one leg chord with at least one toothed rack, comprising a plurality of piston/cylinder units for said at least one toothed rack, each of the plurality of piston/cylinder units having an extendable and retractable piston and toothed rack engagement member driven by its piston, the piston/cylinder units of said plurality of piston/cylinder units being pivotally attached to and carried by the MODU platform so their central axes are pivoted through a small angle for engagement and disengagement of their toothed rack engagement members;

a plurality of engagement/disengagement means for engaging and disengaging the toothed rack engagement members of the plurality of piston/cylinder units with the toothed rack;

a source of hydraulic pressure for driving the pistons of the plurality of piston/cylinder units; and control means for operating said plurality of piston/cylinder units and said plurality of engagement/disengagement means, said control means providing a continuous relative motion between the MODU platform and the MODU supporting leg during jacking operations by operating a portion of the engagement/disengagement means and engaging a portion of the plurality of toothed rack engagement members of a portion of the plurality of piston/cylinder units with the toothed rack, and operating said engaged portion of the plurality of piston/cylinder units to provide said continuous relative motion while operating one of the plurality of the engagement/disengagement means and disengaging the toothed rack engagement member of one of the plurality of piston/cylinder units and operating the disengaged one of the plurality of piston/cylinder units to reposition the disengaged toothed rack engagement member for re-engagement with the toothed rack and providing said continuous relative motion.

14. The MODU jacking system of claim 13 wherein the at least one toothed rack comprises a plurality of teeth with planar engagement surfaces, and the toothed rack engagement members each comprise a plurality of teeth with mating planar engagement surfaces, the angles of the planar engagement surfaces of the mating teeth of the toothed rack and toothed rack engagement members being normal to the central axes of the plurality of piston/cylinder units at mid-stroke of the pistons' extension.

15. The MODU jacking system of claim 13, wherein at least one of the pivotal attachments of the plurality of piston/cylinder units includes a loud sensor with an output providing an operator signal.

16. The MODU jacking system of claim 15 wherein said operator signal provides a warning in the event of an unacceptable load sensed by the load sensor.

17. The MODU jacking system of claim 13 wherein said teeth of the toothed rack and toothed rack engagement members have a tooth pitch T; the number of cylinders in the plurality of piston/cylinder units is N; the vertical travel of the toothed rack engagement members is T×N, and the vertical distance between the pivotal attachments of each of the N piston/cylinder units is T(N−1).

18. The MODU jacking system of claim 13 wherein the toothed rack engagement members and the toothed rack have pluralities of teeth with mating angled planar engagement surfaces, and the mating angled planar engagement surfaces of the plurality of teeth, with the pistons at mid-extension, are normal to the central axes of the piston/cylinder units, and said mating angled planar engagement teeth surfaces, when engaged, apply pressure substantially uniformly across the angled planar engagement surfaces of the plurality of engaged teeth.

19. The MODU jacking system of claim 18, wherein said plurality of engaged angled planar engagement surfaces of said toothed rack engagement members and said toothed rack generate, in their engagement, forces resisting disengagement of the toothed rack engagement members from the toothed racks with the pistons of the plurality of piston/cylinder units in their retracted positions.

20. The MODU jacking system of claim 18 wherein said plurality of engaged angled planar engagement surfaces of said toothed rack engagement members and said toothed rack generate, in their engagement, forces assisting disengagement of the toothed rack engagement members from the toothed rack with the pistons of the plurality of piston/cylinder units hilly extended.

21. A method of jacking a MODU platform without interruption, comprising:

providing a plurality of MODU supporting legs;

providing a plurality of toothed racks fastened to said plurality of MODU supporting legs;

providing at least three hydraulic piston/cylinder units attached to said MODU platform, each of said at least three hydraulic piston/cylinder units having a toothed rack engagement member attached to and driven in a vertical direction by its piston and engageable with one of said toothed racks;

engaging a portion of the plurality of said toothed rack engagement members of a portion of said at least three piston/cylinder units with said toothed racks; and driving said engaged portion of the plurality of toothed rack engagement members by applying hydraulic pressure to said portion of the at least three piston/cylinder units to extend their pistons and thereby continuously provide relative motion between the MODU platform and MODU supporting legs while a remainder of the toothed rack engagement members are disengaged from said toothed racks and are being repositioned for engagement with the toothed racks by applying hydraulic pressure to retract their pistons.

22. In a MODU jacking system comprising a MODU platform, a plurality of MODU supporting legs, and means for providing relative motion between the MODU platform and the plurality of MODU supporting legs, the improvement wherein said means for providing relative motion between the MODU platform and plurality of MODU supporting legs comprises a plurality of continuous linear motion motors, with at least one such motor for each of the plurality of MODU supporting legs, each of said plurality of continuous linear motion motors comprising N hydraulic piston/cylinder units, wherein N is three or more, and wherein operation of the pistons of said N hydraulic piston/cylinder units is phased during jacking so that at most N−1 units are engaged with the MODU supporting legs and providing said relative motion at all times while at least one of said N units is disengaged from the toothed rack and is being repositioned for re-engagement with the toothed rack to provide said relative motion.

23. In the improved MODU jacking system of claim 22, the further improvement wherein the continuous relative motion between the MODU platform and the MODU supporting legs is provided by control means for engaging a portion of the N hydraulic piston/cylinder units and operating their pistons for a long driving cycle while said at least one of said piston/cylinder units is disengaged from the MODU supporting leg and is being repositioned during a repositioning cycle substantially shorter than the drive cycle.

24. In a MODU jacking system comprising a MODU platform, a plurality of MODU supporting legs and means for providing relative motion between the MODU platform and the plurality of MODU supporting legs, the improvement wherein said means for providing relative motion between the MODU platform and the plurality of MODU supporting means comprises of at least three piston/cylinder units for each MODU supporting leg, each of said at least three piston/cylinder units having a toothed rack engagement member attached to its piston and each of the MODU supporting legs having a toothed rack, wherein continuous relative motion is provided between the MODU platform and MODU supporting legs by phased engagement of toothed rack engagement members with the toothed racks and phased operation of the pistons of the piston/cylinder units of the engaged toothed rack engagement members, and wherein the MODU platform and MODU supporting legs can be locked together in a stationary position by engagement of all of the toothed rack engagement members of all of the piston/cylinder units with the toothed racks.

25. In the improved MODU jacking system of claim 24, the further improvement wherein the MODU platform and MODU supporting legs are locked in a selected stationary position by control means for ceasing phased operation of the pistons of the at least three piston/cylinder units, disengaging the toothed rack engagement members of an engaged portion of the at least three piston/cylinder units from the toothed racks while maintaining engagement of the remainder of the toothed rack engagement members with the toothed racks, retracting the pistons of said portion of the at least three piston/cylinder units with said disengaged toothed rack engagement members until substantially entirely within the cylinders of said portion of the piston/cylinder units, and re-engaging the retracted toothed nick engagement members of said portion of the piston/cylinder units with the toothed racks, and repeating the operation with different portions of the at least three piston/cylinder units until all pistons of the piston/cylinder units are substantially entirely within their cylinders with all toothed rack engagement members engaged with the toothed racks.

26. In the improved MODU jacking system of claim 24 the further improvement comprising a plurality of means for engagement and disengagement of the toothed rack engagement members from the toothed racks, the means for engagement and disengagement of each toothed rack engagement member including a compression spring urging each toothed rack engagement member into engagement with a toothed rack, wherein no power is expended in locking the MODU platform and MODU supporting legs in said stationary position.

27. The improved MODU jacking system of claim 26 wherein said means for engagement and disengagement for each toothed rack engagement member comprises a hydraulic piston/cylinder attached to said toothed rack engagement members to overcome the urging of the compression spring and disengage the toothed rack engagement member from the toothed rack.

28. In a MODU jacking system comprising a MODU platform, a plurality of MODU supporting legs and means for providing relative motion between the MODU platform and the plurality of MODU supporting legs, the improvement wherein said means for providing relative motion between the MODU platform and the plurality of MODU supporting means comprises a plurality of piston/cylinder units for each MODU supporting leg, each of said plurality of piston/cylinder units having a toothed rack engagement member attached to its piston and each of the MODU supporting legs having a toothed rack, wherein said plurality of piston/cylinder units are pivotally attached at their cylinder ends to the MODU platform, said piston/cylinder units being pivoted to effect the engagement and disengagement of the toothed rack engagement members during the operation, and wherein said toothed racks have a plurality of teeth with angled planar engagement surfaces, and said toothed rack engagement members have a plurality of teeth with mating angled planar engagement surfaces, and wherein continuous relative motion is provided between the MODU platform and MODU supporting legs by phased engagement of toothed rack engagement members with the toothed racks and phased operation of the pistons of the piston/cylinder units of the engaged toothed rack engagement members, and wherein the MODU platform and MODU supporting legs can be locked together in a stationary position by engagement of all of the toothed rack engagement members of all of the piston/cylinder units with the toothed racks, said plurality of angled planar engagement surfaces of said toothed rack engagement members and said toothed racks generating in their engagement, forces resisting the disengagement of the toothed rack engagement members with the pistons in their retracted positions.

29. A method for providing relative motion between a MODU platform and a MODU supporting leg comprising providing at least three piston/cylinder motor units, each of the at least three piston/cylinder motor units having an extendable and retractable piston with a leg engagement member;

providing at least three engagement/disengagement means for engaging and disengaging the leg engagement members of the at least three piston/cylinder motor units with the MODU supporting leg;

providing a source of fluid pressure for driving the pistons of the at least three piston/cylinder motor units;

operating a portion of the engagement/disengagement means and engaging a portion of the plurality of the leg engagement members of a portion of the at least three piston/cylinder motor units with the MODU supporting leg, and operating said portion of the at least three piston/cylinder motor units with leg engagement members engaged with the MODU supporting leg to provide continuous relative motion between said MODU platform and said MODU supporting leg while operating at least one of the plurality of the engagement/disengagement means and disengaging the leg engagement member of at least one of the at least three piston/cylinder motor units and operating each at least one of the at least three piston/cylinder motor units with a leg engagement member disengaged from the MODU supporting leg to reposition the disengaged leg engagement member for re-engagement with the MODU supporting leg and providing said continuous relative motion.

30. The method of claim 29 comprising locking the MODU platform in a stationary position with respect to the MODU supporting leg by ceasing said continuous relative motion, disengaging a portion of the engaged leg engagement members of said engaged portion of the at least three piston/cylinder motor units from the MODU supporting leg while maintaining engagement of the leg engagement members of the remainder of said portion of the piston/cylinder motor units, operating the piston/cylinder motor units of the disengaged portion of the engagement members to retract their pistons substantially entirely within their cylinders;

re-engaging the retracted leg engagement members of said disengaged portion of the piston/cylinder motor units, and repeating the operation with different portions of the leg engagement members and of the at least three piston/cylinder motor units until all pistons of the at least three piston/cylinder motor units are substantially entirely within their cylinders with all leg engagement members engaged with the MODU supporting leg.

31. A method for providing relative motion between a MODU platform and a MODU supporting a leg, comprising providing a plurality of piston/cylinder motor units wherein the plurality of piston/cylinder motor units may be pivoted with respect to the MODU supporting leg, each of the plurality of piston/cylinder motor units having an extendable and retractable piston with a leg engagement member, providing a plurality of engagement/disengagement means for engaging and disengaging the leg engagement members of the plurality of piston/cylinder motor units with the MODU supporting leg and engaging and disengaging the leg engagement members of the plurality of piston/cylinder motor units by pivoting the piston/cylinder motor units;

providing a source of fluid pressure for driving the pistons of the plurality of piston/cylinder motor units;

operating a portion of the engagement/disengagement means and engaging a portion of the plurality of the leg engagement members of a portion of the plurality of piston/cylinder motor units with the MODU supporting leg, and operating said portion of the plurality of piston/cylinder motor units with leg engagement members engaged with the MODU supporting leg to provide continuous relative motion between said MODU platform and said MODU supporting leg while operating at least one of the plurality of engagement/disengagement means and disengaging the leg engagement member of at least one of the plurality of piston/cylinder motor units and operating each at least one of the plurality of piston/cylinder motor units with a leg disengagement member disengaged from the MODU supporting leg to reposition the disengaged leg engagement member for re-engagement with the MODU supporting leg and providing said continuous relative motion.

32. The method of claim 31 further comprising the steps of resisting the disengagement of said leg engagement members from said MODU supporting leg during locking of said MODU platform with respect to said MODU supporting leg by providing said leg engagement members and said MODU supporting leg with mating angled planar engagement surfaces, whereby said pivoting of the plurality of piston/cylinder motor units generates, in the engagement of the mated angled planar engagement surfaces, forces resisting the disengagement of the leg engagement members from the MODU supporting leg.

33. The method of claim 31 further comprising the steps of assisting the disengagement of said leg engagement members from said MODU supporting leg during said continuous relative motion by providing said leg engagement members and said MODU supporting leg with mating angled, planar engagement surfaces, whereby said pivoting of the plurality of piston/cylinder motor units generates, in the engagement of the mated angled planar engagement surfaces, forces assisting the disengagement of the leg engagement members from the MODU supporting leg.

34. In a method for providing relative motion between the MODU platform and plurality of MODU supporting legs, the improvement comprising, providing a plurality of continuous linear motion motors, with at least one of the continuous linear motion motors for each of the plurality of MODU supporting legs, each of said plurality of continuous linear motion motors comprising N hydraulic piston/cylinder units, where N is three or more, and phasing the operation of the pistons of said N hydraulic piston/cylinder units of each continuous linear motion motor during relative motion between the MODU platform and MODU supporting legs by engaging at most N−1 piston/cylinder units with the MODU supporting legs and operating the pistons of the at most N−1 piston/cylinder units, and providing continuous relative motion between said MODU platform and said plurality of MODU supporting legs while disengaging at least one of the piston/cylinder units from the MODU supporting leg, operating the pistons of the disengaged at least one piston/cylinder unit, and repositioning the disengaged at least one piston/cylinder unit for re-engagement with the MODU supporting leg and to provide said continuous relative motion.

35. In the method of claim 34, the further improvement comprising locking the MODU platform and MODU supporting legs in a selected stationary position by ceasing phased operation of the pistons of the N piston/cylinder units, disengaging a portion of N piston/cylinder units from the MODU supporting legs while maintaining engagement of the remainder of the N piston/cylinder units with the MODU supporting legs, retracting the pistons of the disengaged portion of the N piston/cylinder units substantially entirely within the cylinders of the disengaged portion of the N piston/cylinder units, and re-engaging the disengaged portion of the N piston/cylinder units with the MODU supporting legs, and repeating the operation with different portions of the N piston/cylinder units until all pistons of the N piston/cylinder units are substantially entirely within their cylinders and are engaged with the MODU supporting legs.

* * * * *

UNITED STATES PATENT AND TRADEMARK OFFICE

CERTIFICATE OF CORRECTION

PATENT NO. : 6,652,194 B1
DATED : November 25, 2003
INVENTOR(S) : James E. Ingle It is certified that error appears in the above-identified patent and that said Letters Patent is hereby corrected as shown below:

Column 1,
Line 7, please delete “dwelling” and insert -- drilling --.

Column 18,
Line 10, please delete “loud” and insert -- load --.

Column 19,
Line 64, please delete “nick” and insert -- rack --.

Signed and Sealed this

Sixteenth Day of March, 2004

JON W. DUDAS
*Acting Director of the United States Patent and Trademark Office*